US007885566B2

(12) United States Patent
Konishi et al.

(10) Patent No.: US 7,885,566 B2
(45) Date of Patent: Feb. 8, 2011

(54) TONER CONSUMPTION-CALCULATING APPARATUS, IMAGE FORMING APPARATUS, AND TONER CONSUMPTION CALCULATING METHOD

(75) Inventors: Rumi Konishi, Osaka (JP); Kenichi Ono, Tokyo (JP); Akihiro Kawasaki, Hyogo (JP); Yoshiko Ogawa, Osaka (JP); Atsushi Takehara, Kyoto (JP)

(73) Assignee: Ricoh Company, Limited, Tokyo (JP)

( * ) Notice: Subject to any disclaimer, the term of this patent is extended or adjusted under 35 U.S.C. 154(b) by 95 days.

(21) Appl. No.: 11/854,143

(22) Filed: Sep. 12, 2007

(65) Prior Publication Data

US 2008/0075480 A1 Mar. 27, 2008

(30) Foreign Application Priority Data

Sep. 22, 2006 (JP) ..... 2006-256944

(51) Int. Cl.
*G03G 15/10* (2006.01)

(52) U.S. Cl. ..... 399/60; 399/30; 399/49; 347/131

(58) Field of Classification Search ..... 399/24, 399/27–30, 49, 53, 60; 347/131, 256
See application file for complete search history.

(56) References Cited

U.S. PATENT DOCUMENTS 7,289,743 B2 * 10/2007 Kin et al. ..... 399/27
2006/0140650 A1 * 6/2006 Yokote ..... 399/27
2006/0233559 A1 * 10/2006 Sugita et al. ..... 399/27
2006/0280529 A1 12/2006 Nakagawa et al.

FOREIGN PATENT DOCUMENTS

| | | |
|---|---|---|
| JP | 2003-215983 | 7/2003 |
| JP | 2003-302877 | 10/2003 |
| JP | 2004-347800 | 12/2004 |
| JP | 2005-208461 | 8/2005 |
| JP | 2006-171023 | 6/2006 |

OTHER PUBLICATIONS

U.S. Appl. No. 12/141,464, filed Jun. 18, 2008, Sakagawa, et al.

* cited by examiner

*Primary Examiner*—David M Gray
*Assistant Examiner*—Barnabas T Fekete
(74) *Attorney, Agent, or Firm*—Oblon, Spivak, McClelland, Maier & Neustadt, L.L.P.

(57) ABSTRACT

A toner consumption-calculating apparatus includes a printed portion area-detecting unit that detects an area of a printed portion of image data of a latent image that is formed on a latent image-bearing member; a latent image portion area-detecting unit that detects an area of a latent image portion on the latent image-bearing member; and a latent image portion toner consumption-calculating unit that calculates latent image portion toner consumption that indicates toner amount that is consumed due to adhering on the latent image portion. The latent image portion toner consumption-calculating unit uses a detection result of the latent image portion area-detecting unit and a detection result of the printed portion area-detecting unit to calculate the latent image portion toner consumption.

7 Claims, 6 Drawing Sheets

TONER CONSUMPTION-CALCULATING APPARATUS, IMAGE FORMING APPARATUS, AND TONER CONSUMPTION CALCULATING METHOD

CROSS-REFERENCE TO RELATED APPLICATIONS

The present application claims priority to and incorporates by reference the entire contents of Japanese priority document, 2006-256944 filed in Japan on Sep. 22, 2006.

BACKGROUND OF THE INVENTION

1. Field of the Invention

The present invention relates to a toner consumption-calculating apparatus, which calculates consumption of toner that adheres on a latent image-bearing member of an image forming apparatus such as a copier, a printer, a facsimile etc., the image forming apparatus that includes the toner consumption-calculating apparatus, and a toner consumption calculating method.

2. Description of the Related Art

In an image forming apparatus, which forms an image using toner, a mechanism that can report to a user, toner consumption or a remaining toner amount is desirable for maintenance such as toner replenishment. Due to this, the toner consumption needs to be calculated every time the image formation is performed.

In a commonly used method for calculating the toner consumption, a number of individual dots that form an image from image data are counted, and the toner consumption is calculated by assuming that the number of dots is proportional to the toner consumption. However, because a relation between a continuity of the dots that form a toner image and the toner consumption is nonlinear, the toner consumption cannot be accurately calculated by simply multiplying the number of the dots by the toner consumption per dot. Because an interference degree of an exposure beam changes according to an alignment (density) of the dots, an area of a printed portion based on the image data differs from an area of a latent image portion on a photosensitive drum. Moreover, due to an edge effect resulting from a sharp change in a surface potential of the latent image portion and a non-latent image portion in a boundary vicinity of the latent image portion and the non-latent image portion on the photosensitive drum, a large amount of toner adheres on a boundary vicinity portion of the latent image portion with the non-latent image portion compared to a central portion of the latent image portion. Due to this, the relation between the continuity of the dots and the toner consumption becomes nonlinear.

In an image forming apparatus disclosed in Japanese Patent Laid-open Application No. 2006-171023, based on the image data, a toner consumption-calculating unit is used to calculate the toner consumption along with development of the image corresponding to the image data and the calculated toner consumption is multiplied by a predetermined correction factor that is less than 1 to carry out a correction of the toner consumption. For example, if the maximum value of an error between the calculated toner consumption and the actual toner consumption is plus or minus 20 percent, correction is carried out such that the corrected toner consumption is less than or equal to 80 percent of the calculated toner consumption.

In an image forming apparatus that is disclosed in Japanese Patent Laid-open Application No. 2005-208461, a correction process is carried out based on a quantitative analysis of the relation between the continuity of the dots and the toner consumption. To be specific, a value (toner adhesion amount) is obtained by dividing a total amount of the toner that adheres on a single dot portion by a length of the dot portion and a correlation is calculated between the toner adhesion amount and a size of the dot portion in a main scanning direction. Data related to a dot size is integrated and a process is carried out to correct the nonlinearity between the dot size and the toner consumption.

However, in the correction that is carried out by the image forming apparatus disclosed in Japanese Patent Laid-open Application No. 2006-171023, because the calculated toner consumption is greater than the actual toner consumption, the toner is excessively replenished at the time of toner replenishment. To prevent excessive toner replenishment, the calculated toner consumption is reduced to less than the actual toner consumption. Thus, in the correction mentioned earlier, because the calculated toner consumption is not approximately equal to the actual toner consumption, the toner consumption cannot be precisely calculated by using a calculation.

Although the image forming apparatus disclosed in Japanese Patent Laid-open Application No. 2005-208461 carries out a correcting process of the toner adhesion amount using the alignment (density) of the dots in the main scanning direction, the image forming apparatus does not carry out the correcting process of the toner adhesion amount using the alignment (density) of the dots in a vertical scanning direction. Due to this, a difference between the calculated toner consumption and the actual toner consumption using the alignment of the dots in the vertical scanning direction cannot be detected. Thus, a precision in the calculation of the toner consumption needs to be further enhanced.

SUMMARY OF THE INVENTION

It is an object of the present invention to at least partially solve the problems in the conventional technology.

According to an aspect of the present invention, a toner consumption-calculating apparatus, which calculates toner consumption that indicates toner amount that is consumed due to adhering on a latent image-bearing member in a developing area where the latent image-bearing member and a developing unit are positioned opposite to each other, includes a printed portion area-detecting unit that detects an area of a printed portion of image data of a latent image that is formed on the latent image-bearing member; a latent image portion area-detecting unit that detects an area of a latent image portion on the latent image-bearing member; and a latent image portion toner consumption-calculating unit that calculates latent image portion toner consumption that indicates toner amount that is consumed due to adhering on the latent image portion. The latent image portion toner consumption-calculating unit uses a detection result of the latent image portion area-detecting unit and a detection result of the printed portion area-detecting unit to calculate the latent image portion toner consumption.

According to another aspect of the present invention, a toner consumption-calculating apparatus, which calculates toner consumption that indicates toner amount that is consumed due to adhering on a latent image-bearing member in a developing area where the latent image-bearing member and a developing unit are positioned opposite to each other, includes a latent image portion toner consumption-calculating unit that calculates, from a latent image that is formed on the latent image-bearing member, based on dot data related to a size of at least two dots in a vertical scanning direction of a dot portion on which toner is to be adhered, latent image portion toner consumption. The latent image portion toner consumption-calculating unit integrates values of the dot data corresponding to each dot that is developed within a predetermined time period, carries out on the integrated value, a correcting process that corrects a nonlinearity between a dot size and toner adhesion amount, and calculates the latent image portion toner consumption that is used to develop the dot portion within the time period.

According to still another aspect of the present invention, an image forming apparatus includes a latent image-bearing member that bears a latent image; a developing unit that uses a developing material to develop the latent image on the latent image-bearing member; and the above toner consumption-calculating apparatus.

According to still another aspect of the present invention, a method of calculating toner consumption, wherein the toner consumption indicates toner amount consumed due to adhering on a latent image-bearing member in a developing area where the latent image-bearing member and a developing unit are positioned opposite to each other. The method includes calculating the toner consumption by using an area of a printed portion of image data of a latent image that is formed on the latent image-bearing member and an area of a latent image portion on the latent image-bearing member.

According to still another aspect of the present invention, a method of calculating toner consumption, wherein the toner consumption indicates toner amount consumed due to adhering on a latent image-bearing member in a developing area where the latent image-bearing member and a developing unit are positioned opposite to each other. The method includes calculating, from a latent image that is formed on the latent image-bearing member, based on dot data related to a size of at least two or more dots in a vertical scanning direction of a dot portion on which toner is to be adhered, latent image portion toner consumption; integrating values of the dot data corresponding to each dot that is developed within a predetermined time period; and performing, on the integrated value, a correcting process that corrects a nonlinearity between a dot size and a toner adhesion amount to calculate the latent image portion toner consumption that is used to develop the dot portion within the time period.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained below. The present invention is applied to a printer 100, which is an image forming apparatus, in the embodiments of the present invention.

Figure 2:
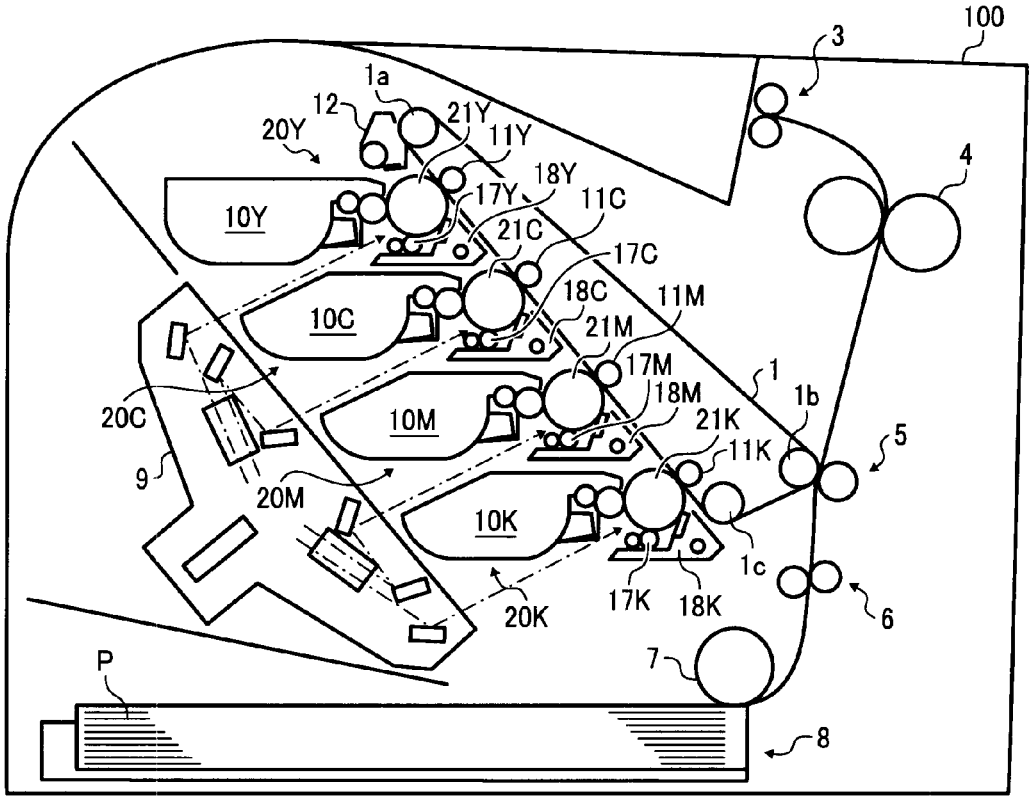
FIG. 2 is a schematic of an overview of a printer according to the first embodiment.

A structure and an operation of the entire printer 100 according to an embodiment of the present invention are explained first with reference to FIG. 2.

The printer 100 includes a tandem image-forming unit consisting of four image forming units of yellow, cyan, magenta, and black that are slantingly arranged. As shown in FIG. 2, individual toner image-forming units 20Y, 20C, 20M, and 20K are serially arranged in the tandem image-forming unit from upper left portion. Code characters Y, C, M, and K indicate members for yellow, magenta, cyan, and black colors, respectively. The tandem image-forming unit includes the toner image-forming units 20Y, 20C, 20M, and 20K around latent image-bearing members in the form of photosensitive drums 21Y, 21C, 21M, and 21K, a charging device that includes charging units in the form of charging rollers 17Y, 17C, 17M, and 17K, developing units in the form of developing devices 10Y, 10C, 10M, and 10K, and photosensitive drum-cleaning devices 18Y, 18C, 18M, and 18K.

Further, an optical writing unit 9 is arranged as a latent image-forming unit in a lower portion of the tandem image-forming unit. The optical writing unit 9 includes a light source, a polygon mirror, an f-θ lens, a reflecting mirror etc. Based on image data, the optical writing unit 9 emits a laser beam on a surface of each photosensitive drum 21 while scanning.

An endless intermediate transfer belt 1 is arranged as an intermediate transferring member along the slantingly arranged tandem image-forming unit. The intermediate transfer belt 1 is wound on supporting rollers 1*a*, 1*b*, and 1*c*. A not shown driving motor which is used as a driving source is linked to a rotation axis of a driving roller 1*a*. As shown in FIG. 2, by driving the driving roller 1*a*, the intermediate transfer belt 1 is rotatably moved in a counterclockwise direction and drivable driven rollers 1*b* and 1*c* are rotated. A first transferring device is arranged on the inner side of the intermediate transfer belt 1. The first transferring device includes first transferring rollers 11Y, 11C, 11M, and 11K that transfer the toner images formed on the photosensitive drums 21Y, 21C, 21M, and 21K respectively to the intermediate transfer belt 1.

A secondary transferring device is arranged at a downstream side from the first transferring rollers 11Y, 11C, 11M, and 11K in the driving direction of the intermediate transfer belt 1. The secondary transferring device includes a secondary transferring roller 5. The supporting roller 1*b*, which is arranged on the opposite side across the secondary transferring roller 5 and the intermediate transfer belt 1, functions as a pressing member. The printer 100 further includes a feeding cassette 8, a feeding roller 7, a resist roller 6 etc. The printer 100 also includes a fixing device 4 and a paper ejecting roller 3 at a downstream side from the secondary transferring roller 5 in a moving direction of a transfer sheet P that is a recording medium on which the toner images are transferred by the secondary transferring roller 5. The fixing device 4 fixes the image on the transfer sheet P.

The operation of the printer 100 is explained next. The toner image-forming units 20Y, 20C, 20M, and 20K rotate the respective photosensitive drums 21Y, 21C, 21M, and 21K. Along with the rotation of the photosensitive drums 21Y, 21C, 21M, and 21K, surfaces of the photosensitive drums 21Y, 21C, 21M, and 21K are uniformly charged by the respective charging rollers 17Y, 17C, 17M, and 17K. Next, the image data is subjected to the emission of write light using the laser from the optical writing unit 9 and electrostatic latent images are formed on the photosensitive drums 21Y, 21C, 21M, and 21K.

Next, the toner adheres to the developing devices 10Y, 10C, 10M, and 10K, thereby converting the electrostatic latent images into visible images. Thus, yellow, cyan, magenta, and black monochromatic images are formed on the photosensitive drums 21Y, 21C, 21M, and 21K respectively. Further, the driving roller 1*a* is rotatably driven by the not shown driving motor to rotate the other supporting rollers 1*b* and 1*c* that are the driven rollers and the intermediate transfer belt 1 is rotatably transported to sequentially transfer the visual images on the intermediate transfer belt 1 using the first transferring devices 11Y, 11C, 11M, and 11K. Due to this, a synthesized color image is formed on the intermediate transfer belt 1. After the image transfer, the photosensitive drum-cleaning devices 18Y, 18C, 18M, and 18K, which are cleaning units, clean the surface of the photosensitive drums 21Y, 21C, 21M, and 21K by removing the residual toner, thereby preparing the photosensitive drums 21Y, 21C, 21M, and 21K for image formation once again.

The feeding roller 7 sends out a tip of the transfer sheet P from the feeding cassette 8 in tune with a timing of image formation. The transfer sheet P is transported to the resist roller 6 and stops. Next, the transfer sheet P is transported between the secondary transferring roller 5 and the intermediate transfer belt 1 in tune with the timing of the image forming operation. The transfer sheet P is sandwiched between the intermediate transfer belt 1 and the secondary transferring roller 5, thus forming a secondary transfer nip. The toner image on the intermediate transfer belt 1 is secondary transferred to the transfer sheet P in the secondary transfer nip.

After the image transfer, the transfer sheet P is transmitted to the fixing device 4. The fixing device 4 adds heat and pressure to fix the transferred image on the transfer sheet P and the transfer sheet P is ejected from the printer 100. After the image transfer, an intermediate transferring member-cleaning unit 12 removes the residual toner from the intermediate transfer belt 1, thereby once again preparing the intermediate transfer belt 1 for image formation by the tandem image-forming unit.

The toner image-forming units 20Y, 20C, 20M, and 20K mentioned earlier are process cartridges that are integrally formed and that can be detachably attached to a main body of the printer 100. The integral process cartridges can be pulled towards the front side of the main body of the printer 100 along a not shown guide rail that is fixed to the main body of the printer 100. Further, by pushing the process cartridges towards the backside of the main body of the printer 100, the toner image-forming units 20Y, 20C, 20M, and 20K can be loaded at predetermined positions.

The process cartridges of the toner image-forming units 20Y, 20C, 20M, and 20K include the same structure and carry out the same operation. The process cartridges of the toner image-forming units 20Y, 20C, 20M, and 20K are explained in detail by omitting the code characters Y, C, M, and K.

Figure 3:
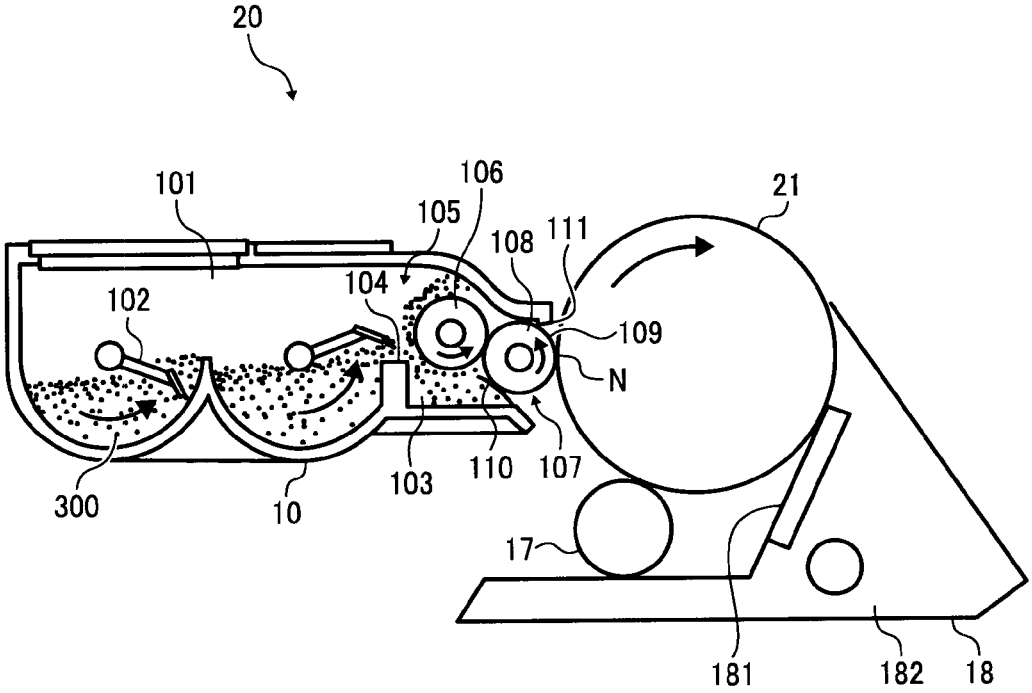
FIG. 3 is a schematic of an overview of a process cartridge.

An enlarged outline of the structure of the process cartridge of the toner image-forming unit 20 is shown in FIG. 3.

In the developing device 10 shown in FIG. 3, a toner transporting member 102 is arranged as a developing material-transporting member inside a toner housing chamber 101 that is a developing material-housing unit. The toner transporting member 102 rotates in a counterclockwise direction. Due to this, housed developing material in the form of toner 300 is transmitted in a direction of a toner supplying chamber 103. An opening 105 is included in a partitioning wall 104 of the toner housing chamber 101 and the toner supplying chamber 103. An operation of the toner transporting member 102 moves the toner 300 from the opening 105 to the toner supplying chamber 103.

A supplying roller 106 which is included inside the toner supplying chamber 103 is arranged such that the supplying roller 106 touches a developing roller 107 that is a developing material bearing member.

In the supplying roller 106, a supplying bias, which is of a value that is offset in the same direction as a charge polarity of the toner, is applied against a developing bias. The supplying bias operates in a direction in which the precharged toner is pressed on the developing roller 107 by a portion of the supplying roller 106 that touches the developing roller 107. The supplying roller 106 rotates in the counterclockwise direction and supplies by applying on the surface of the developing roller 107, the toner that is adhering on the surface of the supplying roller 106.

A toner layer-regulating member 110 which is a developing layer-regulating member regulates a toner layer on the surface of the developing roller 107 to a specific thin layer.

The toner layer-regulating member 110 is arranged at a downstream side from a touching position of the supplying roller 106 and the developing roller 107 in a surface moving direction of the developing roller 107. The toner that passes a regulating position of the toner layer-regulating member 110 is thinned by the toner layer-regulating member 110. Further, the toner layer-regulating member 110 also uses frictional charging to apply a charge to the toner.

For supplementing the frictional charging, a regulating bias, which is of a value that is offset in the same direction as the charge polarity of the toner, can also be applied against the developing bias in the toner layer-regulating member 110.

The photosensitive drum 21 rotates in the clockwise direction. The surface of the developing roller 107 moves in the same direction as a moving direction of the photosensitive drum 21 in a developing nip N that is a developing area positioned opposite the photosensitive drum 21.

The toner which is thinned on the surface of the developing roller 107 by the toner layer-regulating member 110 is transported due to the rotations of the developing roller 107 to the developing nip N that is opposite the photosensitive drum 21. According to the developing bias that is applied to the developing roller 107 and a latent image electric field that is formed due to the electrostatic latent image on the photosensitive drum 21, the toner moves on the surface of the photosensitive drum 21 where the toner is developed and the toner image is formed.

The surface of the photosensitive drum 21, which receives a supply of the toner in the developing nip N, transfers the toner image to the intermediate transfer belt 1 at a portion opposite the first transferring roller 11. After the image transfer, a cleaning blade 181 removes the transferred residual toner from the surface of the photosensitive drum 21. The transferred residual toner which is removed by the cleaning blade 181 is recycled by a waste toner-recycling unit 182.

Figure 4:
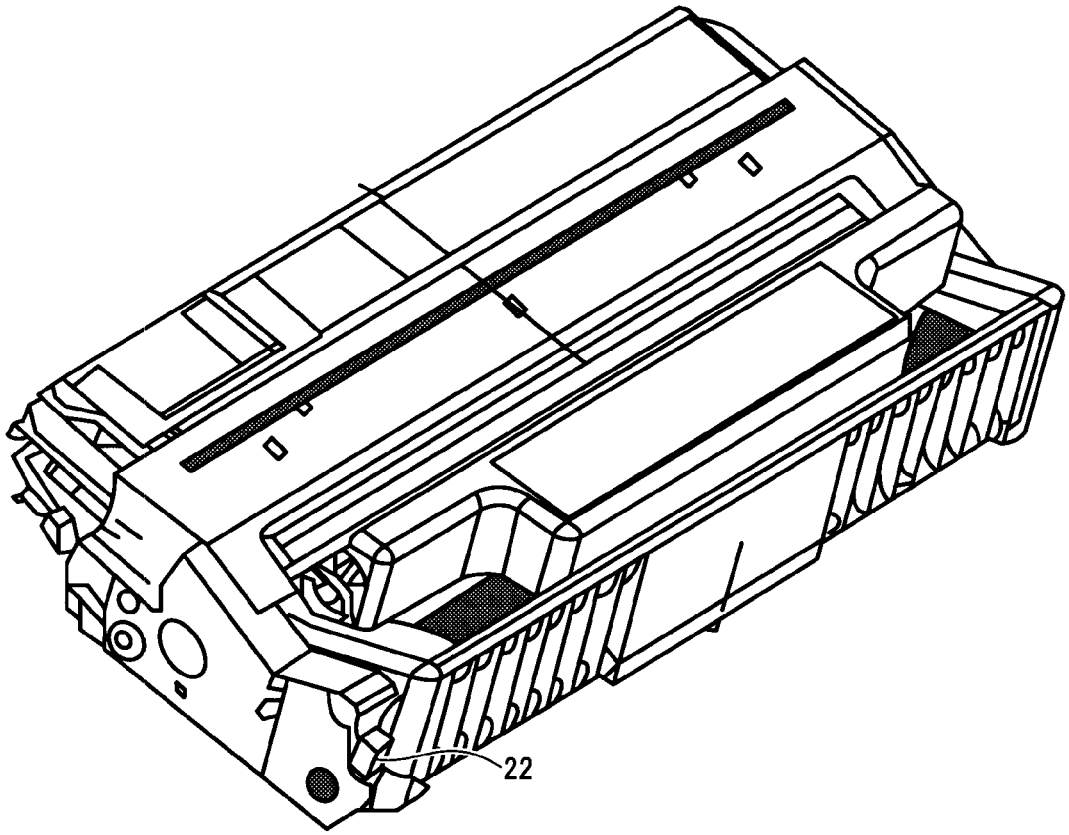
FIG. 4 is an external perspective of the process cartridge.

FIG. 4 is a schematic of the process cartridge of the toner image-forming unit 20.

The process cartridge of the toner image-forming unit 20 is integrated with the photosensitive drum 21 that is shown in FIG. 3 and the developing device 10 that includes the toner housing chamber 101. Further, the process cartridge of the toner image-forming unit 20 also integrally supports the charging roller 17, the cleaning blade 181, and the photosensitive drum-cleaning device 18 that includes the waste toner-recycling unit 182.

A memory tag 22 is mounted on the process cartridge of the toner image-forming unit 20. A nonvolatile memory is loaded in the memory tag 22. The memory tag 22 stores therein data that is necessary for controlling the process cartridge of the toner image-forming unit 20 such as a cartridge identification (ID), a manufacturing date, a use start date, a recycle count, a number of copies, and a current date.

Instead of the memory tag 22, a printed circuit board that includes a mounted integrated circuit (IC) chip or a printed circuit board that includes a mounted noncontact type IC chip can also be mounted on the process cartridge of the toner image-forming unit 20.

A salient feature of the present invention is explained next.

The main body of the printer 100 includes a not shown toner consumption-calculating apparatus 30 in the developing area where the photosensitive drum 21 and the developing roller 107 are positioned opposite to each other. The toner consumption-calculating apparatus 30 calculates toner consumption that indicates toner amount that is consumed due to adhesion of the toner on the photosensitive drum 21. The toner consumption-calculating apparatus 30 includes a latent image portion area-calculating unit 31, a printed portion area-calculating unit 32, a data storage unit 33, and a latent image portion toner consumption-calculating unit 34. The latent image portion area-calculating unit 31 calculates a latent image portion area on the photosensitive drum 21. The printed portion area-calculating unit 32 calculates a printed portion area based on the image data. The data storage unit 33 stores therein data related to the toner consumption that is calculated based on a relation of at least one of the latent image portion area and the printed portion area. The latent image portion toner consumption-calculating unit 34 calculates latent image portion toner consumption that indicates toner amount that is consumed due to adhesion of the toner on a latent image portion. The toner consumption-calculating apparatus 30 is explained below in detail.

Due to an edge effect resulting from a sharp change in a surface potential of the latent image portion and a non-latent image portion in a boundary vicinity of the latent image portion and the non-latent image portion on the photosensitive drum 21, a large amount of toner adheres on a boundary vicinity (edge) portion of the latent image portion with the non-latent image portion, compared to a central portion of the latent image portion. Due to this, if the toner consumption is calculated based on only the printed portion area that is integrated by counting a number of dots in the printed portion area, an error occurs between the calculated toner consumption and the actual toner consumption. The edge effect is taken into consideration during a calculation of the toner consumption that is explained in a first embodiment of the present invention.

Figure 5:
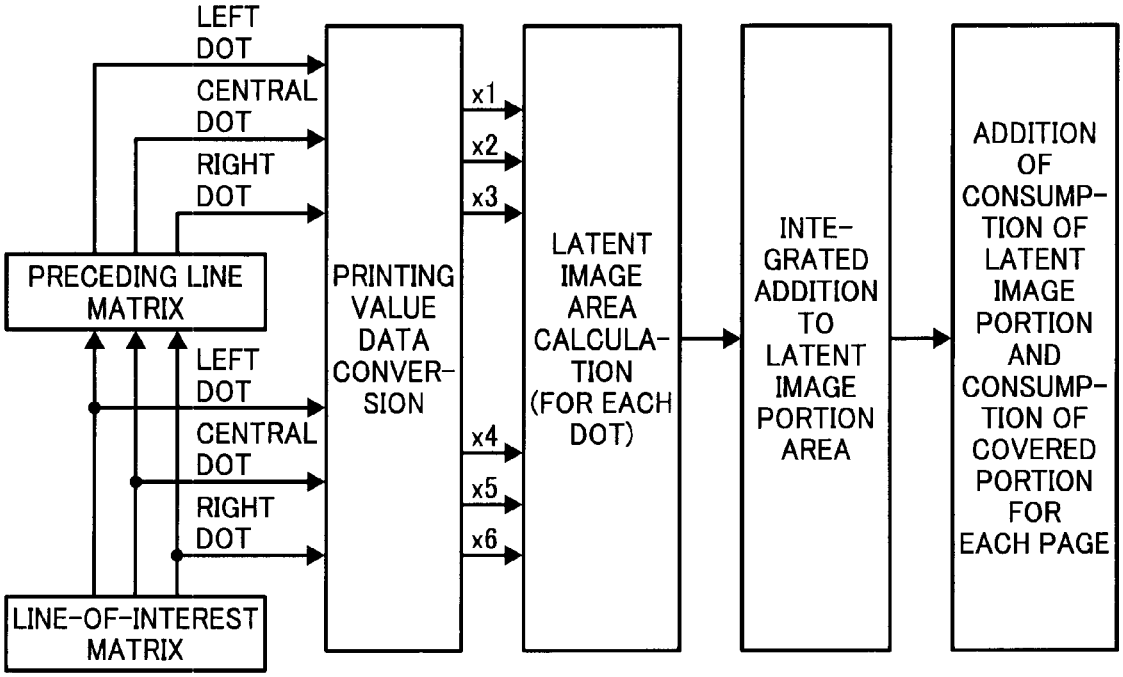
FIG. 5 is a block diagram of a control system related to the latent image portion area calculation.

An overview of a toner consumption calculation according to the first embodiment is explained with reference to FIG. 5.

First, the toner consumption-calculating apparatus 30 reads exposure data of a main scanning line (a line of interest) that includes a dot of interest of the latent image portion on the photosensitive drum 21 and exposure data of a main scanning line (a preceding line) that is prior exposed immediately before the line of interest. Next, the toner consumption-calculating apparatus 30 converts into respective printing value data, the exposure data of three dots that include the dot of interest of the line of interest and two dots in the vicinity of the dot of interest and the exposure data of three dots in the preceding line that are in the vicinity of the three dots of the line of interest. The toner consumption-calculating apparatus 30 uses the six printing value data and calculates a latent image area of the dot of interest. The toner consumption-calculating apparatus 30 carries out the calculation mentioned earlier for all the dots of the line of interest and cumulatively adds calculation results in a memory. Thus, the toner consumption-calculating apparatus 30 carries out a latent image portion area calculation for each page and uses the calculation results for conversion into the toner consumption. Further, the toner consumption-calculating apparatus 30 adds toner consumption calculated using a prior stored cover to the toner consumption calculated from the latent image portion area to calculate the toner consumption for each single page.

Figure 1:
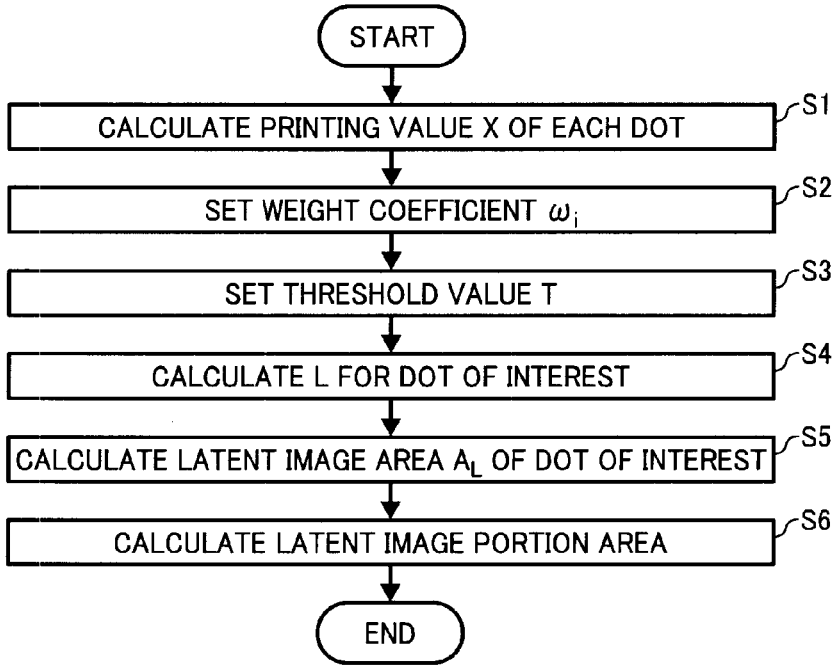
FIG. 1 is a flowchart of a latent image portion area calculation according to a first embodiment of the present invention.
Figure 6:
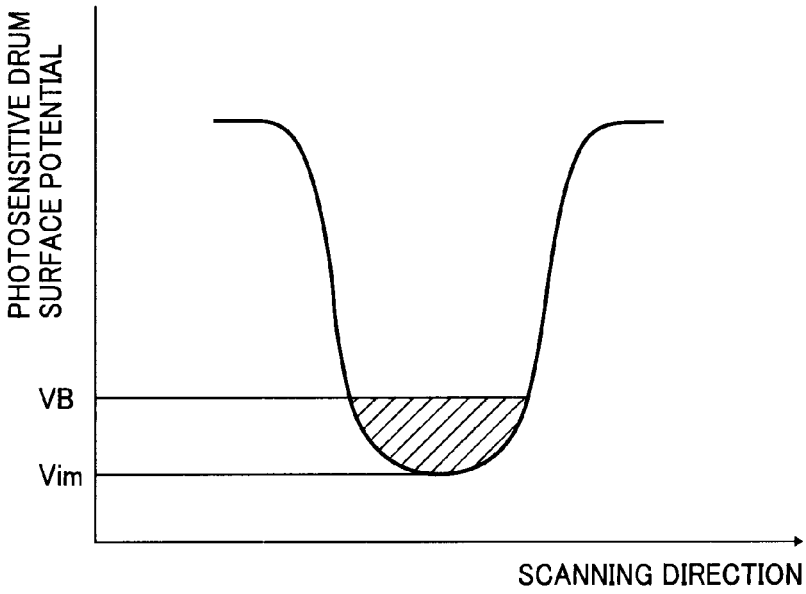
FIG. 6 is a graph for explaining a photosensitive drum surface potential.

A flowchart of the latent image portion area calculation is shown in FIG. 1. The toner consumption-calculating apparatus 30 calculates a printing value $X_i$ of each dot from the exposure data (step S1). The printing value $X_i$ indicates signal data for exposure or processed signal data. The printing value $X_i$ corresponds to an emission time period of the laser and exposure intensity for a dot. For example, if printing is carried out in a binary value mode, a printing value of a print dot becomes 1 and the printing value of a non-print dot becomes 0. If printing is carried out in a single dot-multiple value mode using a pulse width modulation (PWM) etc., the printing value takes a plurality of values. Next, the toner consumption-calculating apparatus 30 sets for a total of six dots that include the dot of interest and the dots adjacent to the dot of interest, a weight coefficient $\omega_i$ according to a relative position i of the dots with respect to the dot of interest (step S2). The weight coefficient $\omega_i$ corresponds to an exposure intensity distribution and indicates a contribution ratio of the printing value of each dot to a latent image formation (attenuation of a photosensitive drum surface potential) in the dot of interest. Next, the toner consumption-calculating apparatus 30 sets a threshold value T for counting only a range that is indicated by a shaded portion shown in FIG. 6 and that is considered to be effective as the latent image area, in other words, the range in which the attenuation of the photosensitive drum surface potential has fallen below a developing bias $V_B$ (step S3). Next, the toner consumption-calculating apparatus 30 uses the printing values $X_i$ of each dot, the weight coefficient $\omega_i$, and the threshold value T to calculate a calculation result L for the dot of interest from the following expression (step S4):

$$L=\Sigma\omega_i X_i-T.$$

Note that because $V_{IM}$ indicates that the photosensitive drum surface potential is saturated, the calculation result L when the photosensitive drum surface potential is equal to a saturation potential $V_{IM}$ is stipulated as an upper limit $L_{upper}$.

Next, the toner consumption-calculating apparatus 30 uses a correlation between a latent image area $A_L$ of the dot of interest that is prior stored in the data storage unit 33 and the calculation result L to calculate the image area $A_L$ of the dot of interest (step S5). If $L_{upper}$ is less than or equal to L, the latent image area $A_L$ is calculated based on $L_{upper}$. If L is greater than 0 but less than $L_{upper}$, the latent image area $A_L$ is calculated based on L. If L is less than or equal to 0, the latent image area $A_L$ is taken as zero.

By integrating the latent image areas $A_L$ that are calculated using the process mentioned earlier, the (virtual) latent image area of the entire image can be calculated while including the influence due to the edge effect (step S6). Although six dots are used in the present embodiment for calculating the calculation result L, the number of the dots can be increased or reduced according to a structural difference (grayscale γ characteristics) of the image forming apparatus.

Figure 7:
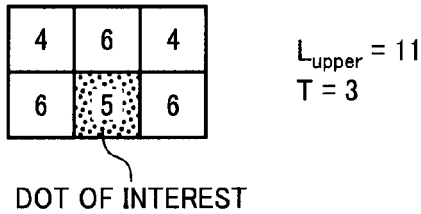
FIG. 7 is a schematic of an example of setting values that are used in the latent image portion area calculation.
Figure 8:
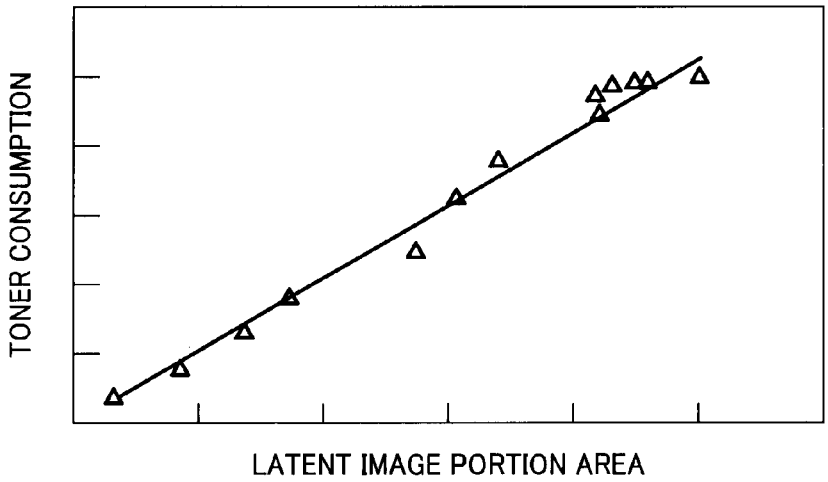
FIG. 8 is a graph of a correlation between a latent image portion area and toner consumption.

FIG. 7 is a schematic of an example of setting of $\omega_i$, T, and $L_{upper}$. FIG. 8 is a graph of a correlation between the latent image portion area and the toner consumption that are calculated using setting values that are shown in FIG. 7. Because the virtually calculated latent image portion area is calculated while including the influence due to the edge effect, the correlation between the latent image portion area and the toner consumption is nearly proportional. Thus, storing in advance the correlation shown in FIG. 8 in the data storage unit 33 enables to calculate the toner consumption from the latent image portion area that is calculated using the sequence mentioned earlier. Further, a value, which is obtained by multiplying the calculated toner consumption by a correction coefficient according to a use environment and a degree of durability of a developing device, can also be treated as the toner consumption.

The correlation between the latent image portion area and the toner consumption, as shown in FIG. 8, changes according to the use environment and use conditions at the time of image formation. Due to this, the correlation needs to be timely corrected for precisely calculating the toner consumption.

First, a plurality of patches of different densities are printed on the intermediate transfer belt 1 at predetermined timings that are decided based on a number of print sheets, a drive time of a developing device, detection of environment change etc. The toner adhesion amount of each patch is detected using a not shown optical sensor 35 and grayscale γ characteristics are examined. A combination of $\omega_i$, T, and $L_{upper}$ corresponding to the grayscale γ characteristics is prior calculated using a test and is stored in a contrast table. Next, the latent image portion area is calculated by using the most appropriate values of $\omega_i$, T, and $L_{upper}$ for the grayscale γ characteristics. By using the latent image portion area thus calculated and the toner consumption of the patches that is detected by the optical sensor 35, the correlation between the latent image portion area and the toner consumption can be corrected.

The latent image portion area can also be calculated by splitting a single dot into sub-pixels. To be specific, based on the exposure data that is input into the toner consumption-calculating apparatus 30, a single dot is split into four sub-pixels in the main scanning direction and a printing value $X_i'$ corresponding to each sub-pixel is determined. When using the binary value mode as a printing mode, if the original dot is a print dot, the printing value $X_i'$ of all the split sub-pixels becomes 1. If the original split dot is a non-print dot, the printing value $X_i'$ of all the split sub-pixels becomes 0. If the PWM or a smoothing function is applied, although a unit of image formation becomes less than a single dot, splitting the dot into the sub-pixels enhances a resolution of latent image calculation and enables to precisely calculate the latent image area.

Next, the toner consumption-calculating apparatus 30 sets for a total of six dots that include a main sub-pixel and sub-pixels adjacent to the main sub-pixel, a weight coefficient $\omega_i'$ according to a relative position i' of the sub-pixels with respect to the main sub-pixel. Next, the toner consumption-calculating apparatus 30 sets a threshold value T' for counting only a range that is considered to be effective as the latent image area, in other words, the range in which the attenuation of the photosensitive drum surface potential has fallen below the developing bias $V_B$. Next, the toner consumption-calculating apparatus 30 uses the printing values $X_i'$ of each sub-pixel, the weight coefficient $\omega_i'$, and the threshold value T' to calculate a calculation result L' for the main sub-pixel from the following expression:

$$L' = \Sigma \omega_i' X_i' - T'.$$

Further, because $V_{IM}$ indicates that the photosensitive drum surface potential is saturated, the calculation result L' when the photosensitive drum surface potential is equal to the saturation potential $V_{IM}$, is stipulated as an upper limit $L_{upper}'$.

Next, the toner consumption-calculating apparatus 30 uses a correlation between a latent image area $A_L'$ of the main sub-pixel that is prior stored in the data storage unit 33 and the calculation result L' to calculate the latent image area $A_L'$ of the main sub-pixel. If $L_{upper}'$ is less than or equal to L', the latent image area $A_L'$ is calculated based on $L_{upper}'$. If L' is greater than 0 but less than $L_{upper}'$, the latent image area $A_L'$ is calculated based on L'. If L' is less than or equal to 0, the latent image area $A_L'$ is taken as zero.

By integrating the latent image areas $A_L'$ that are calculated using the process mentioned earlier, the (virtual) latent image portion area of the entire image can be calculated while including the influence due to the edge effect. Based on the calculated latent image portion area, the toner consumption can be calculated from the correlation between the latent image portion area and the toner consumption that is shown in FIG. 8.

If a unit dot of the maximum resolution guaranteed by the smoothing function is taken as a sub-pixel, a latent image area calculation corresponding to image formations of different resolutions can be carried out using a single calculating device. For example, in an image forming apparatus having a real resolution of 600 dots per inch (dpi) and that enables to get a resolution of 2400 dpi in the main scanning direction and 600 dpi in the vertical scanning direction using the smoothing function, splitting a single dot of 600 dpi mode into four sub-pixels in the main scanning direction and using the sub-pixels enables to calculate the latent image portion area for any one of the resolutions of 600 dpi and 2400 dpi without changing the settings.

Due to a difference in sizes of the printed portion area and the latent image portion area, an error occurs between the toner consumption that is calculated only from the printed portion area and the actual toner consumption.

Figure 9A:
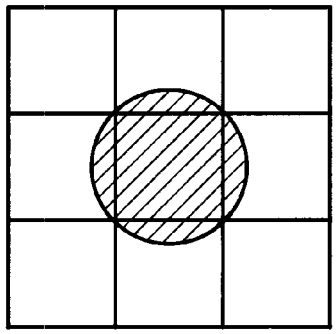
FIG. 9A is a schematic for explaining a situation when the latent image portion area becomes greater than a printed portion area.
Figure 9B:
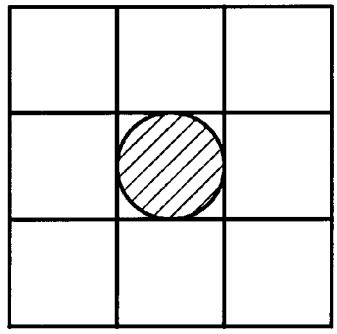
FIG. 9B is a schematic for explaining a situation when the latent image portion area becomes smaller than the printed portion area.

Generally, the laser beam, which is emitted on the surface of the photosensitive drum 21 from the optical writing unit 9 based on the image data, is of a circular shape or an oval shape. Due to this, as indicated by the shaded portion that is shown in FIG. 9A for example, when adhering the toner on the entire surface of a single square dot, the laser beam needs to be emitted on an area that is wider than the single dot. Thus, the latent image portion area, which is formed on the photosensitive drum 21 due to emission of the laser beam, becomes larger than the printed image area. Moreover, changing the intensity and the exposure time period of the laser beam also changes the size of the circular shape or the oval shape of the laser beam. Thus, as indicated by the shaded portion that is shown in FIG. 9B, the latent image portion area may become smaller than even the single dot. Due to this, an error occurs between the toner consumption that is calculated only from the printed portion area and the actual toner consumption. Accordingly, the toner consumption needs to be calculated by correcting the error.

Figure 10:
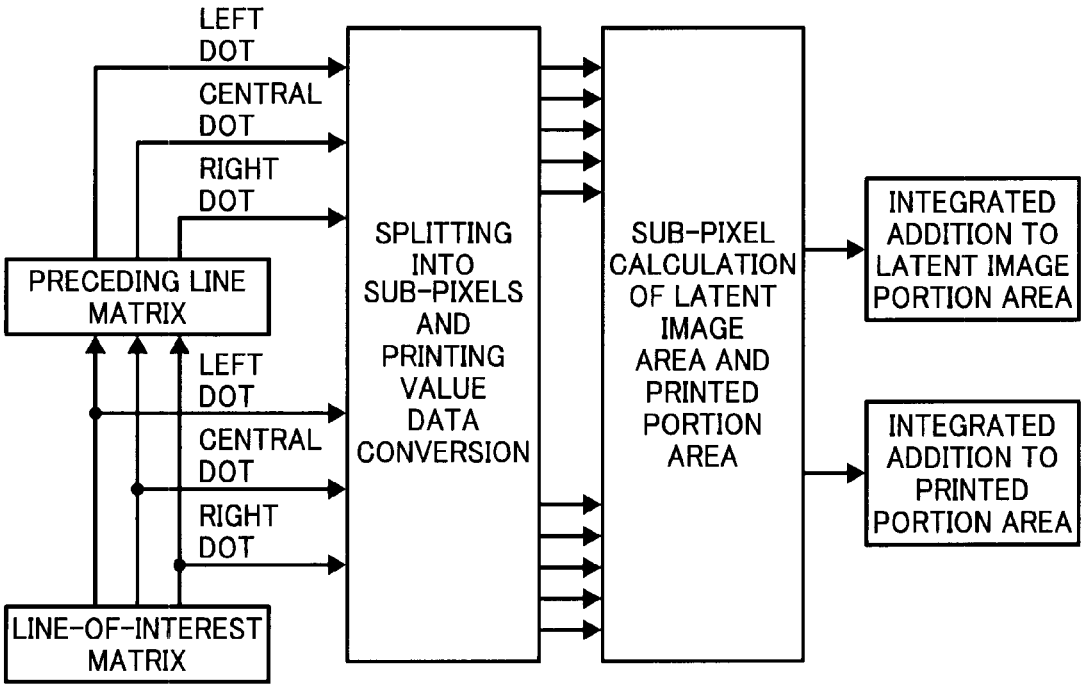
FIG. 10 is a block diagram of a control system related to the latent image portion area calculation and a printed portion area calculation.

An overview of a latent image portion area calculation and a printed portion area calculation according to a second embodiment of the present invention is explained with reference to FIG. 10.

First, the toner consumption-calculating apparatus 30 reads the exposure data of the main scanning line (the line of interest) that includes the dot of interest of the latent image portion on the photosensitive drum 21 and the exposure data of the main scanning line (the preceding line) that is prior exposed immediately before the line of interest. Next, the toner consumption-calculating apparatus 30 splits into the respective sub-pixels, the exposure data of three dots that include the dot of interest of the line of interest and two dots in the vicinity of the dot of interest and the exposure data of three dots in the preceding line that are in the vicinity of the three dots of the line of interest. The toner consumption-calculating apparatus 30 converts the exposure data into the printing value data for each sub-pixel. The size of the sub-pixels is the same as the size of a single pixel of the maximum resolution that is enabled by using the smoothing function. The toner consumption-calculating apparatus 30 uses the printing value data of the sub-pixels to calculate the latent image area of the main sub-pixel. The toner consumption-calculating apparatus 30 carries out the calculation mentioned earlier for all the sub-pixels of the line of interest and cumulatively adds calculation results in the memory. Thus, the toner consumption-calculating apparatus 30 carries out the latent image portion area calculation for each page. Further, the toner consumption-calculating apparatus 30 counts a number of printed sub-pixels in the line of interest (the sub-pixels having the printing values of more than zero), multiplies the area of a single sub-pixel by the number of the printed sub-pixels to calculate the printed area of the single sub-pixel, and cumulatively adds the calculation results to the memory to calculate the printed portion area for each page.

Calculation of the latent image portion area and the printed portion area is explained in detail. First, the toner consumption-calculating apparatus 30 calculates the printing value $X_i$ of each dot from the exposure data. The printing value $X_i$ indicates the signal data for exposure or the processed signal data. The printing value $X_i$ corresponds to the emission time period and the exposure intensity of the laser for the dot. For example, if printing is carried out in the binary value mode, the printing value of the print dot becomes 1 and the printing value of the non-print dot becomes 0. If printing is carried out in the single dot-multiple value mode using the PWM etc., the printing value takes multiple values. Next, the toner consumption-calculating apparatus 30 sets for a total of six dots that include the dot of interest and the dots adjacent to the dot of interest, the weight coefficient $\omega_i$ according to the relative position i of the dots with respect to the dot of interest. The weight coefficient $\omega_i$ corresponds to the exposure intensity distribution and indicates the contribution ratio of the printing value of each dot to the latent image formation (attenuation of the photosensitive drum surface potential) in the dot of interest. Next, the toner consumption-calculating apparatus 30 sets the threshold value T for counting only the range that is considered to be effective as the latent image area, in other words, the range in which the attenuation of the photosensitive drum surface potential has fallen below the developing bias $V_B$. Next, the toner consumption-calculating apparatus 30 uses the printing value $X_i$ of each dot, the weight coefficient $\omega_i$, and the threshold value T to calculate the calculation result L for the dot of interest by using the following expression:

$$L=\Sigma\omega_i X_i-T.$$

Further, because VIM indicates that the photosensitive drum surface potential is saturated, the calculation result L when the photosensitive drum surface potential is equal to the saturation potential $V_{IM}$ is stipulated as the upper limit $L_{upper}$.

Next, the toner consumption-calculating apparatus 30 uses the correlation, prior stored in the data storage unit 33, between the latent image area $A_L$ of the dot of interest and the calculation result L to calculate the latent image area $A_L$ of the dot of interest. If $L_{upper}$ is less than or equal to L, the latent image area $A_L$ is calculated based on $L_{upper}$. If L is greater than 0 but less than $L_{upper}$, the latent image area $A_L$ is calculated based on L. If L is less than or equal to 0, the latent image area $A_L$ is taken as zero. By integrating the latent image areas $A_L$ that are calculated using the process mentioned earlier, the (virtual) latent image area of the entire image can be calculated. Although a calculating method described in the first embodiment is used to calculate the latent image portion area in the second embodiment, the method to calculate the latent image portion area is not to be thus limited and other methods can also be used. For example, based on the exposure data at the time of forming the latent image on the photosensitive drum 21, the photosensitive drum surface potential of the latent image portion can be grasped and the area of the latent image portion can be calculated based on a difference between the photosensitive drum surface potential and the developing bias $V_B$.

Further, because the toner consumption-calculating apparatus 30 includes the printed portion area-calculating unit 32 which counts the number of dots of the printed portion to calculate the printed portion area separately from the latent image portion area-calculating unit 31 that calculates the latent image portion area, a ratio R between the latent image portion area and the printed portion area can be calculated for a predetermined image. By calculating the ratio R between the latent image portion area and the printed portion area, a difference between the sizes of the latent image portion area and the printed portion area can be grasped.

Figure 11:
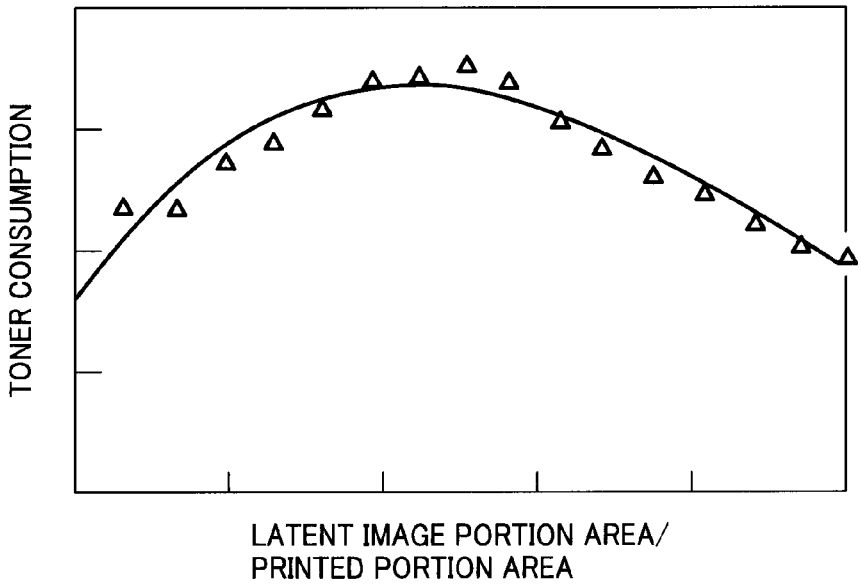
FIG. 11 is a graph for explaining a correlation between a ratio of the latent image portion area and the printed portion area and the toner consumption.

FIG. 11 is a graph for explaining a correlation between the ratio R, between the latent image portion area and the printed portion area that are calculated according to the sequence mentioned earlier, and a toner consumption Y per unit printed area. A function Y=f(R) which represents the correlation between Y and R that are shown in FIG. 11 is prior stored in the toner consumption-calculating apparatus 30. The toner consumption-calculating apparatus 30 uses the correlation between Y and R that are shown in FIG. 11 to calculate, from the ratio R between the latent image portion area and the printed portion area, the toner consumption Y per unit printed area. Multiplying the calculated toner consumption Y per unit printed area by the printed portion area that is calculated by the toner consumption-calculating apparatus 30 enables to calculate the toner consumption that is corrected for the error that occurs in the toner consumption due to the difference between the sizes of the latent image portion area and the printed portion area. The correlation between R and Y is stored as a function in the second embodiment. However, the correlation between R and Y can also be stored as the contrast table.

The correlation shown in FIG. 11 between the ratio R, of the latent image portion area and the printed portion area, and the toner consumption Y per unit printed area changes according to the use environment and the use conditions at the time of image formation. Due to this, the correlation mentioned earlier needs to be timely corrected for precisely calculating the toner consumption.

First, a plurality of patches of different densities are printed on the intermediate transfer belt 1 at the predetermined timings that are decided based on the number of print sheets, the drive time of a developing device, detection of environment change etc. The not shown optical sensor 35 calculates the toner adhesion amount of each patch. Next, the toner consumption-calculating apparatus 30 uses the sequence mentioned earlier to calculate for the patches, the ratio R between the latent image portion area and the printed portion area. Thus, the ratio R of the latent image portion area and the printed portion area and the toner consumption calculated by the optical sensor 35 are used to calculate the toner consumption Y per unit printed area. Thus, the correlation between Y and R, which are stored in the data storage unit 33, can be corrected.

In a method explained below, the error between the toner consumption that is calculated from the printed portion area and the actual toner consumption is corrected by using the difference between the latent image portion area and the printed portion area instead of using the ratio R of the latent image portion area and the printed portion area.

The toner consumption-calculating apparatus 30 calculates the latent image portion area according to the sequence mentioned earlier. Further, the toner consumption-calculating apparatus 30 prior stores a toner consumption W1 per a first unit area corresponding to a printed portion area A1 of the image data and a toner consumption W2 per a second unit area corresponding to a difference A2 between the latent image portion area and the printed portion area. By using each value mentioned earlier, a toner consumption C can be calculated from the following expression:

$$C=W1\times A1-W2\times A2.$$

Upon assuming that the difference A2 between the latent image portion area and the printed portion area is the area of an edge portion of the latent image portion, the toner consumption can be precisely calculated by calculating the toner consumption W2 per the second unit area while considering the edge effect.

According to the embodiments, the toner consumption-calculating apparatus 30 calculates the toner consumption that is the amount of the toner consumed due to adhesion on the photosensitive drum 21 in the developing area where the latent image-bearing member in the form of the photosensitive drum 21 and the developing unit in the form of the developing roller 107 are positioned opposite to each other. The toner consumption-calculating apparatus 30 includes the printed portion area-calculating unit 32 that detects the area of the printed portion of the image data of the latent image that is formed on the photosensitive drum 21, the latent image portion area-calculating unit 31 that detects the area of the latent image portion on the photosensitive drum 21, and the latent image portion toner consumption-calculating unit 34 that calculates the latent image portion toner consumption that is the amount of the toner consumed due to adhesion on the latent image portion. The latent image portion toner consumption-calculating unit 34 calculates the latent image portion toner consumption by using the latent image portion area that is a detection result of the latent image portion area-calculating unit 31 and the printed portion area that is a detection result of the printed portion area-calculating unit 32. The size of the printed portion area differs from the size of the latent image portion area corresponding to the printed portion area. Due to this, an error occurs between the toner consumption that is calculated only from the printed portion area and the actual toner consumption. To overcome the drawback, the latent image portion toner consumption-calculating unit 34 calculates the latent image portion toner consumption according to a degree of difference between the sizes of the latent image portion area and the printed portion area, thus enabling to calculate the toner consumption by correcting the error. Because the toner consumption is calculated by using the latent image portion area on which the toner image is formed instead of using only the printed portion area, the toner consumption can be calculated more precisely than the toner consumption that is calculated based on only the printed portion area of the image data.

Further, according to the embodiments, the latent image portion toner consumption-calculating unit 34 calculates the latent image portion toner consumption according to the ratio between the latent image portion area and the printed portion area. Thus, the degree of difference between the latent image portion area and the printed portion area is calculated from the ratio R of the latent image portion area and the printed portion area and the latent image portion toner consumption-calculating unit 34 uses the calculation result to calculate the latent image portion toner consumption. Due to this, the toner consumption can be calculated by correcting the error that occurs due to the difference in the sizes of the latent image portion area and the printed portion area.

Further, according to the embodiments, the toner consumption-calculating apparatus 30 includes the data storage unit 33 that stores therein as data, the toner consumption per unit printed area that corresponds to the ratio between the latent image portion area and the printed portion area. The latent image portion toner consumption-calculating unit 34 multiplies the printed portion area by the toner consumption per unit printed area to calculate the latent image portion toner consumption. Thus, the toner consumption per unit area is calculated based on the ratio R between the latent image portion area and the printed portion area. Due to this, the toner consumption can be calculated by correcting the error that occurs due to the difference in the sizes of the latent image portion area and the printed portion area.

According to the embodiments, the latent image portion toner consumption-calculating unit 34 calculates the latent image portion toner consumption according to the difference between the latent image portion area and the printed portion area. Thus, the difference between the latent image portion are and the printed portion area is calculated, an area equivalent to the difference is calculated, the toner amount adhering on the area is treated as a correcting amount, and the latent image portion toner consumption-calculating unit 34 uses the correcting amount to correct the toner consumption that is calculated from the printed portion area. Due to this, the toner consumption can be precisely calculated.

According to the embodiments, the toner consumption-calculating apparatus 30 includes a data storage unit that stores as data, the toner consumption W1 per the first unit area corresponding to the printed portion area A1 and the toner consumption W2 per the second unit area corresponding to the difference A2 between the latent image portion area and the printed portion area. The latent image portion toner consumption-calculating unit 34 calculates the latent image portion toner consumption from the expression C=W1×A1+W2×A2. If the latent image portion area is greater than the printed portion area, the latent image portion toner consumption becomes greater than the toner consumption calculated from the printed portion area by a margin of the toner consumption that is calculated by W2×A2. Similarly, if the latent image portion area is smaller than the printed portion area, the latent image portion toner consumption becomes less than the toner consumption calculated from the printed portion area by a margin of the toner consumption that is calculated by W2×A2. Thus, the toner consumption calculated from the printed portion area is corrected by using the toner consumption that is calculated by W2×A2. Due to this, the toner consumption can be precisely calculated.

According to the embodiments, in the developing area where the photosensitive drum 21 and the developing roller 107 are positioned opposite to each other, the toner consumption-calculating apparatus 30 calculates the toner consumption that is the amount of the toner consumed due to adhering on the photosensitive drum 21. The toner consumption-calculating apparatus 30 includes the latent image portion toner consumption-calculating unit 34. From the latent image that is formed on the photosensitive drum 21, based on the dot data related to the size of at least two or more dots in the vertical scanning direction of the dot portion where the toner is to be adhered, the latent image portion toner consumption-calculating unit 34 calculates the toner consumption. The latent image portion toner consumption-calculating unit 34 integrates values of the dot data corresponding to the toner consumption of each dot that is developed within a predetermined time period, carries out the correcting process on the integrated value to correct the nonlinearity between the dot size and the toner adhesion amount, and calculates the latent image portion toner consumption that is used to develop the dot portion within the predetermined time period. Thus, in addition to the correcting process of the toner adhesion amount using the alignment (density) of dots in the main scanning direction, the correcting process of the toner adhesion amount using the alignment (density) of the dots in the vertical scanning direction can also be carried out on the nonlinearity between the dot size and the toner adhesion amount. Thus, the latent image portion toner consumption-calculating unit 34 can calculate the toner consumption more precisely than calculating the toner consumption by carrying out only the correcting process of the toner adhesion amount using the alignment (density) of the dots in the main scanning direction.

According to the embodiments, based on the sub-pixel data related to the size of the multiple sub-pixels that are obtained by splitting one dot in the main scanning direction, the latent image portion toner consumption-calculating unit 34 calculates the toner consumption. The latent image portion toner consumption-calculating unit 34 integrates values of the sub-pixel data corresponding to each sub-pixel that is developed within the predetermined time period, carries out the correcting process on the integrated value to correct the nonlinearity between the dot size and the toner adhesion amount, and calculates the toner consumption that is used to develop the dot portion within the time period. Thus, calculating in sub-pixel units that are less than or equal to the resolution enables to carry out the correcting process that considers the minute area of the latent image portion that is even smaller than a single dot due to the smoothing function or halftone reproduction in a multiple-value method.

According to the embodiments, the toner consumption-calculating apparatus 30 includes the optical sensor 35 that detects the toner adhesion amount of the multiple grayscale patches that are formed on the photosensitive drum 21. A characteristic feature quantity, which indicates the correlation between the latent image portion area and the toner adhesion amount, changes due to the use environment and the use conditions at the time of image formation. Thus, by using the actually measured value of the toner consumption that is detected by the optical sensor 35, the characteristic feature quantity can be corrected to ensure that an error does not occur in the calculation result of the toner consumption-calculating apparatus 30 while calculating the actual toner consumption due to the use environment and the use conditions at the time of image formation.

According to the embodiments, in the developing area where the photosensitive drum 21 and the developing roller 107 are positioned opposite to each other, a toner consumption calculating method is used to calculate the toner consumption that indicates the amount of the toner consumed due to adhering on the photosensitive drum 21. The toner consumption amount calculating method uses the printed portion area which indicates the area of the printed portion of the image data of the latent image that is formed on the photosensitive drum 21 and the latent image portion area that indicates the area of the latent image portion on the photosensitive drum 21 to calculate the toner consumption. Thus, the toner consumption can be calculated by correcting the error that occurs between the toner consumption that is calculated only from the printed portion area and the actual toner consumption. Because the toner consumption is calculated by using the latent image portion area on which the toner image is formed instead of using only the printed portion area of the image data, the toner consumption can be calculated more precisely than the toner consumption that is calculated based on only the printed portion area of the image data.

According to the embodiments, in the developing area where the photosensitive drum 21 and the developing roller 107 are positioned opposite to each other, the toner consumption calculating method is used to calculate the toner consumption that indicates the amount of the toner consumed due to adhering on the photosensitive drum 21. From the latent image that is formed on the photosensitive drum 21, based on the dot data related to the size of at least two or more dots in the vertical scanning direction of the dot portion on which the toner is to be adhered, the latent image portion toner consumption is calculated. The toner consumption calculating method integrates values of the dot data corresponding to the toner consumption of each dot that is developed within the predetermined time period, carries out the correcting process on the integrated value to correct the nonlinearity between the dot size and the toner adhesion amount, and calculates the latent image portion toner consumption that is used to develop the dot portion within the predetermined time period. Thus, in addition to the correcting process of the toner adhesion amount using the alignment (density) of the dots in the main scanning direction, the correcting process of the toner consumption using the alignment (density) of the dots in the vertical scanning direction can also be carried out on the nonlinearity between the dot size and the toner adhesion amount. Due to this, the toner consumption calculating method can calculate the toner consumption more precisely than calculating the toner consumption by carrying out only the correcting process of the toner adhesion amount using the alignment (density) of the dots in the main scanning direction.

In the present invention, a latent image portion toner consumption-calculating unit calculates latent image portion toner consumption by using a latent image portion area that is a detection result of a latent image portion area-detecting unit and a printed portion area that is a detection result of a printed portion area-detecting unit. A size of the printed portion area differs from a size of the latent image portion area corresponding to the printed portion area. Due to this, an error occurs between toner consumption that is calculated only from the printed portion area and the actual toner consumption. To overcome the drawback, the latent image portion toner consumption is calculated according to a degree of difference between the sizes of the latent image portion area and the printed portion area. Thus, the toner consumption can be calculated by correcting the error. Because the toner consumption is calculated by using the latent image portion area on which a latent image is formed instead of using only the printed portion area of image data, the toner consumption can be calculated more precisely compared to the toner consumption that is calculated based on only the printed portion area of the image data.

In the invention according to claim 6, the toner consumption is corrected, due to nonlinearity between a dot size and a toner adhesion amount, by considering an alignment (density) of at least two or more dots in a vertical scanning direction. Due to this, a toner consumption-calculating apparatus can carry out a correcting process of the toner consumption using the alignment (density) of the dots in the vertical scanning direction in addition to the correcting process of the toner adhesion amount using the alignment (density) of the dots in the main scanning direction. Thus, the toner consumption-calculating apparatus can calculate the toner consumption more precisely compared to the toner consumption that is calculated by carrying out only the correcting process of the toner adhesion amount using the alignment (density) of the dots in the main scanning direction.

In the present invention, the latent image portion toner consumption can be calculated according to the degree of difference between the sizes of the latent image portion area and the printed portion area. Thus, the toner consumption can be calculated by correcting the error that occurs between the toner consumption that is calculated only from the printed portion area and the actual toner consumption. Because the toner consumption is calculated by using the latent image portion area on which the toner image is formed instead of using only the printed portion area of the image data, the toner consumption can be calculated more precisely compared to the toner consumption that is calculated based on only the printed portion area of the image data.

In the present invention, the toner consumption is corrected, due to the nonlinearity between the dot size and the toner adhesion amount, by considering the alignment (density) of the dots in at least the vertical scanning direction. Thus, the correcting process of the toner consumption using the alignment (density) of the dots in the vertical scanning direction can be carried out in addition to the correcting process of the toner adhesion amount using the alignment (density) of the dots in the main scanning direction. Thus, the toner consumption can be calculated more precisely compared to the toner consumption that is calculated by carrying out only the correcting process of the toner adhesion amount using the alignment (density) of the dots in the main scanning direction.

According to an embodiment of the present invention, a consumption calculation of toner, which is consumed at the time of image formation, can be carried out more precisely compared to toner consumption that is calculated based on only image data.

According to an embodiment of the present invention, the consumption calculation of the toner, which is consumed at the time of image formation, can be carried out more precisely by considering an alignment (density) of dots in a main scanning direction and a vertical scanning direction.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A toner consumption-calculating apparatus that calculates toner consumption that indicates toner amount that is consumed due to adhering on a latent image-bearing member in a developing area where the latent image-bearing member and a developing unit are positioned opposite to each other, the toner consumption-calculating apparatus comprising:

a latent image portion toner consumption-calculating unit that calculates, from a latent image that is formed on the latent image-bearing member, latent image portion toner consumption in a dot portion on which toner is to be adhered, wherein the latent image portion toner consumption in one dot in the dot portion is calculated based on dot data of dots that include the one dot and dots adjacent to the one dot, and that have a size of at least two dots in a vertical scanning direction, wherein the latent image portion toner consumption-calculating unit integrates values of the dot data corresponding to each dot that is developed within a predetermined time period, carries out, on the integrated value, a correcting process that corrects a nonlinearity between a dot size and toner adhesion amount, and calculates the latent image portion toner consumption that is used to develop the dot portion within the time period, and the latent image portion toner consumption-calculating unit calculates the latent image portion toner consumption C from $$C=W1\times A1+W2\times A2$$

where A1 is a printed portion area, A2 is a difference between a latent image portion area and the printed portion area, W1 is a toner consumption in A1, and W2 is a toner consumption in A2.

2. The toner consumption-calculating apparatus according to claim 1, wherein the latent image portion toner consumption-calculating unit calculates toner consumption based on sub-pixel data related to a size of a plurality of sub-pixels that are obtained by splitting a single dot in a main scanning direction, integrates values of the sub-pixel data corresponding to each sub-pixel that is developed within the predetermined time period, carries out on the integrated value, the correcting process that corrects the nonlinearity between the dot size and the toner adhesion amount, and calculates the latent image portion toner consumption that is used to develop the dot portion within the time period.

3. An image forming apparatus comprising:

a latent image-bearing member that bears a latent image;

a developing unit that uses a developing material to develop the latent image on the latent image-bearing member; and the toner consumption-calculating apparatus according to claim 1.

4. The image forming apparatus according to claim 3, further comprising a toner adhesion amount-detecting unit that detects toner adhesion amount of a plurality of grayscale patches that are formed on the latent image-bearing member.

5. A method of calculating toner consumption, the toner consumption indicating toner amount consumed due to adhering on a latent image-bearing member in a developing area where the latent image-bearing member and a developing unit are positioned opposite to each other, the method comprising:

calculating, from a latent image that is formed on the latent image-bearing member, latent image portion toner consumption in a dot portion on which toner is to be adhered, wherein the latent image portion toner consumption in one dot in the dot portion is calculated based on dot data of dots that include the one dot and dots adjacent to the one dot, and that have a size of at least two dots in a vertical scanning direction;

integrating values of the dot data corresponding to each dot that is developed within a predetermined time period; and performing, on the integrated value, a correcting process that corrects a nonlinearity between a dot size and a toner adhesion amount to calculate the latent image portion toner consumption that is used to develop the dot portion within the time period, wherein:

the calculating calculates the latent image portion toner consumption C from $$C=W1\times A1+W2\times A2$$

where A1 is a printed portion area, A2 is a difference between a latent image portion area and the printed portion area, W1 is a toner consumption in A1, and W2 is a toner consumption in A2.

6. The toner consumption-calculating apparatus according to claim 1, wherein the latent image portion toner consumption in one dot in the dot portion is calculated based on a weighted sum of dot data of dots that include the one dot and dots adjacent to the one dot, and that have a size of at least two dots in a vertical scanning direction.

7. The method of calculating toner consumption according to claim 5, wherein the latent image portion toner consumption in one dot in the dot portion is calculated based on a weighted sum of dot data of dots that include the one dot and dots adjacent to the one dot, and that have a size of at least two dots in a vertical scanning direction.

* * * * *